US006553698B1

(12) United States Patent
Kemeny

(10) Patent No.: US 6,553,698 B1
(45) Date of Patent: Apr. 29, 2003

(54) PORTABLE DISPLAY SYSTEM

(76) Inventor: Mathias D. Kemeny, 4519 Dubois, Vancouver, WA (US) 98661

( * ) Notice: Subject to any disclaimer, the term of this patent is extended or adjusted under 35 U.S.C. 154(b) by 0 days.

(21) Appl. No.: 09/726,717

(22) Filed: Nov. 22, 2000

Related U.S. Application Data

(63) Continuation of application No. 08/902,344, filed on Jul. 29, 1997, now abandoned.

(51) Int. Cl.[7] ..... G09F 23/00; E04H 12/18

(52) U.S. Cl. ..... 40/610; 40/605; 40/606; 160/135; 52/646; 52/655.1

(58) Field of Search ..... 40/605, 606, 610; 160/135; 52/109, 645, 646, 655.1; 403/83, 84, 169, 170, 171, 217; 16/337; 411/508, 509, 913; 24/297

(56) References Cited

U.S. PATENT DOCUMENTS

| | | | |
|---|---|---|---|
| 3,710,806 | A | 1/1973 | Kelly et al. |
| 3,968,808 | A | 7/1976 | Zeigler |
| 4,026,313 | A | 5/1977 | Zeigler |
| 4,276,726 | A | 7/1981 | Derus |
| 4,280,521 | A | 7/1981 | Zeigler |
| 4,290,244 | A | 9/1981 | Zeigler |
| 4,437,275 | A | 3/1984 | Zeigler |
| RE31,565 | E | 4/1984 | Beaulieu |
| RE31,641 | E | 8/1984 | Derus |
| 4,471,548 | A | 9/1984 | Goudie |
| 4,479,340 | A | 10/1984 | Alphonse et al. |
| 4,512,097 | A | 4/1985 | Zeigler |
| 4,522,008 | A | 6/1985 | Zeigler |
| 4,580,375 | A | 4/1986 | Nodskov et al. |
| 4,610,560 | A | 9/1986 | Miller |
| 4,627,210 | A | 12/1986 | Beaulieu |
| 4,631,778 | A | 12/1986 | Kocon et al. |
| 4,653,951 | A | 3/1987 | Bodle et al. |
| 4,658,560 | A | 4/1987 | Beaulieu |
| 4,663,899 | A | 5/1987 | Nodskov et al. |
| 4,712,336 | A | 12/1987 | Backer |
| 4,722,146 | A | 2/1988 | Kemeny |
| 4,747,239 | A | 5/1988 | Zeigler |
| 4,782,428 | A | 11/1988 | Lowell et al. |
| 4,791,761 | A | 12/1988 | Goudie |
| 4,800,663 | A | 1/1989 | Zeigler |
| 4,809,471 | A | 3/1989 | Wichman et al. |
| 4,823,858 | A | 4/1989 | Perutz |
| 4,829,735 | A | 5/1989 | Zwissler |
| 4,838,003 | A | 6/1989 | Zeigler |

(List continued on next page.)

FOREIGN PATENT DOCUMENTS

| | | |
|---|---|---|
| DE | 812361 | 7/1949 |
| DE | 8704312 | 8/1987 |
| EP | 0 106 016 | 4/1984 |
| EP | 0 219 201 | 1/1988 |
| EP | 0 271 088 | 6/1988 |
| GB | 2110786 A | 6/1983 |

*Primary Examiner*—Anthony Knight
*Assistant Examiner*—E Peavey
(74) *Attorney, Agent, or Firm*—Kolisch Hartwell, P.C.

(57) ABSTRACT

Described herein is a portable display system including a collapsible frame comprised of a plurality of box units defined by spaced hubs with pivotable members extending therebetween. In one aspect of the invention, a locking feature is provided between the members and the hub. In another aspect of the invention, a hook-type mounting between the members and the hub is described. More than one of these display systems can be mounted one to another with a clip that is provided between adjacent outward-most hubs of two different systems. A cage also is described, which permits assembly and disassembly of the collapsible unit into two separate packageable parts. A button also is disclosed which permits two parts of the display to be mounted removably to another.

16 Claims, 11 Drawing Sheets

U.S. PATENT DOCUMENTS

| | | | |
|---|---|---|---|
| 4,888,895 | A | 12/1989 | Kemeny |
| 4,926,294 | A | 5/1990 | Beaulieu et al. |
| 4,942,686 | A | 7/1990 | Kemeny |
| 4,970,841 | A | 11/1990 | Zeigler |
| 4,986,016 | A | 1/1991 | Wichman |
| 4,995,212 | A | 2/1991 | Morgan et al. |
| 5,056,291 | A | 10/1991 | Leung |
| 5,078,348 | A | 1/1992 | Babitchenko |
| 5,115,623 | A | 5/1992 | Ahlberg |
| 5,123,550 | A | 6/1992 | Nodskov et al. |
| 5,125,205 | A | 6/1992 | Wichman |
| 5,144,784 | A | 9/1992 | Marti |
| 5,203,134 | A | 4/1993 | Sorenson et al. |
| 5,269,112 | A | 12/1993 | Weinrub et al. |
| RE34,738 | E | 9/1994 | Brady |
| 5,351,843 | A | 10/1994 | Wichman et al. |
| 5,501,051 | A | 3/1996 | Harlan |
| 5,546,720 | A | 8/1996 | LaBruzza |
| 5,560,055 | A | 10/1996 | Ziegler |
| 5,580,203 | A | 12/1996 | Read et al. |
| 5,681,045 | A | 10/1997 | Liao |
| 5,743,418 | A | 4/1998 | Ahrens |

PORTABLE DISPLAY SYSTEM

CROSS-REFERENCE TO RELATED APPLICATIONS

This application is a continuation application of U.S. non-provisional patent application Ser. No. 08/902,344, entitled "Portable Display Apparatus," filed on Jul. 29, 1997 now abandoned.

BACKGROUND OF THE INVENTION

The present invention relates to portable display systems, and more particularly to a portable display system having a collapsible frame which is adapted to receive attachments to support a variety of display surfaces. Many different display systems which are both portable and collapsible are known to those in this art. These systems typically include a plurality of elongate arms attached at their ends to articulation nodes or hubs which allow the frame to be folded into a collapsed condition. Earlier systems, for which I received U.S. Pat. Nos. 4,888,895 and 4,942,686, provide a variety of display arrangements, and yet are relatively simple and inexpensive. These systems can be collapsed into very small spaces for packing and transporting, such as is necessary for sales and trade show purposes.

One feature of my earlier systems which has proven to be particularly advantageous is the capability of firmly locking the display in a fully expanded position. This capability is provided by a plurality of locking arms which are a part of the unit. However, these arms make the unit larger than desirable even when fully collapsed. The arms can be removed, but they need to be disassembled individually, and this sometimes takes more time than was desirable.

Another feature which I sought to improve is the ability to remove more quickly and easily the fabric appliques which are mounted to the front of the display. Because assembly and disassembly always includes mounting and removal of such appliques, any system which reduces the time involved in that operation is of real benefit.

Another feature which I thought could be improved is the ability easily to mount one display to another; typically side-to-side, but perhaps even top-to-bottom.

Because these displays are transported under a variety of conditions, it is beneficial to have a unit which is as rugged as possible, but it also is desirable to be able to repair the unit on site, using few, if any, tools, by one who is not necessarily a trained mechanic.

Of course, it remains my goal to keep the unit as simple and inexpensive as possible, to keep manufacturing expenses down, and to maintain the capability of someone with little skill, experience, or training being able to use the unit.

SUMMARY OF THE INVENTION

The objects of this invention are best achieved by providing a portable display system which includes a collapsible rectangular frame with a plurality of spaced hubs joined together by a plurality of telescoping members. In one aspect of the invention, the hubs include at least two telescoping members which are mounted to one another and are pivotable with respect to the hub. The members include a deflectable locking portion extending therefrom which engages a surface of the hub as the member is pivoted. The hub surface extends outwardly beyond the radius of pivot, thereby deflecting the locking member and causing resistance to pivoting. This resistance to pivoting provides the locking feature.

Another aspect of the invention is a portable display system having a collapsible frame including a plurality of box units defined by a plurality of hinged members which are mounted pivotably to each other and to an array of hubs. The hinged members are mounted pivotably to the hubs by a hook-shaped mounting which rotatably engages a pin which is mounted such that it extends parallel to a face of the hub. By positioning the member adjacent the pin and then rotating the member toward the face of the hub, the hook-shaped member is forced into engagement with the pin. A variation of this aspect of the invention includes an annulus which extends perpendicularly to the face of the hub. In order to disengage the hook-shaped member from the pin, the member is rotated in the opposite direction until it engages the annulus, so that continued pivoting of the member causes the hook-shaped member to disengage from the pin.

Yet another aspect of the invention is a portable display system having a collapsible frame with a plurality of members extending between and pivotably mounted to a plurality of hubs. The outer periphery of the system is defined by some of those hubs. Each of the members is mounted pivotably to a pin in at least one of the hubs. A second pin is defined in each of the hubs. This aspect of the invention includes a clip which extends between one of the peripheral hubs and the peripheral hub of the adjacent display system with a clip extending between the peripheral hub and engaging a pin of the adjacent peripheral hub.

A further aspect of the invention is in the form of a portable display system with a collapsible frame comprised of a plurality of members which are mounted pivotably and extend between a plurality of hubs. At least some of the hubs include a channel bar engagement head. A plurality of channel bars are included and which are mounted to and between a plurality of the hubs, with a V-shaped opening which is designed to engage the channel bar extension in such a way that the extension is guided into the vortex of the V and thereby securely mounted in place.

Another aspect of the invention includes a cage which is disposable around at least a portion of a portable display system in its collapsed mode, the cage having a plurality of raised portions designed to engage a plurality of spaced points on the display system, which points cause various components to become disengaged from one another upon the application of pressure. By mounting the cage to the collapsed display system and exerting a force on it, at least a portion of the collapsible display system is disengaged from another portion.

Yet another aspect of the invention is an engagement button which is designed to mount removably one component to another. The engagement button includes a first member having a pair of parallel, spaced extension members. The button further includes a washer assembly including a washer which encompasses the two extension members and which has a pair of diverging legs extending therefrom in a direction substantially parallel to and disposed between the two extension members. At least one of the extension members has a countersunk converging portion cut therein which faces the washer assembly legs positioned between those extension members. Each of the legs includes a guide member which extends therefrom into a countersunk converging program. As relative movement is effected between the first member and the washer assembly, the guide members and the legs from which they extend are guided inwardly and outwardly by the converging portion. This button has been found to be useful in removably mounting one portion of a collapsible display system to another. In one aspect of this connector engagement button, a pin extends in a direction perpendicular to the extension members and between the legs so that the intersection of the legs cannot pass beyond this pin member, thereby preventing disengagement of the first member and the washer assembly from one another.

These and other objects and advantages of the present invention will become more fully apparent as the description which follows is read in conjunction with the drawings.

DETAILED DESCRIPTION OF THE PREFERRED EMBODIMENT

Figure 1:
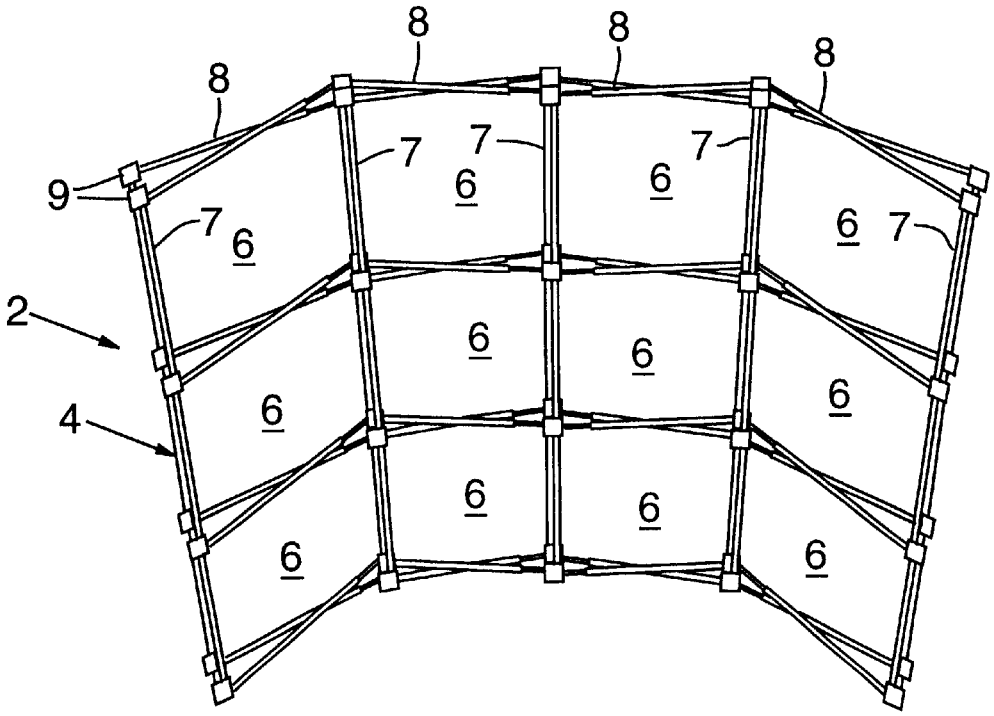
FIG. 1 PRIOR ART
FIG. 1 is a perspective view of the frame of a prior art system depicted in my U.S. Pat. No. 4,942,686.

FIG. 1 depicts the portable display system 2 disclosed in my U.S. Pat. No. 4,942,686. This prior art display includes a frame 4 which can be opened into an array, and then can be collapsed for transport from one location to another. Frame 4 is made up of a plurality of rectangular box units, such as shown at 6 and defined by pairs of cylindrical telescoping arms 8. Both horizontal and vertical arms are included, although the vertical arms do not show in FIG. 1 because of the presence of the hinged vertical supports 7. These vertical supports 7 lock the display in its opened position, thereby supporting the vertical weight of the display and any appurtenances mounted to it. The telescoping arms 8 are pinned at their intersection with other arms, with slots disposed within the arms to limit the amount of travel of the telescoping arrangement. Neither the pins nor the slots appear in this view. The various parts of display 2 are mounted together by an array of hubs 9, to which the telescoping arms are mounted pivotally.

Throughout this description, reference has been made to the fact that the cylindrical arms 8 telescope with respect to each other. However, in the preferred embodiment of this invention, only the horizontally extending cylindrical arms 8 telescope with respect to each other. Therefore, arms 16*c, d, g*, and *h*, to be described below, are not preferably the telescoping type. Therefore, the figures and the following discussion should be understood to describe a variant of the preferred embodiment. In fact, it is possible in some embodiments that none of cylindrical arms 8 will be telescoping.

Figure 2:
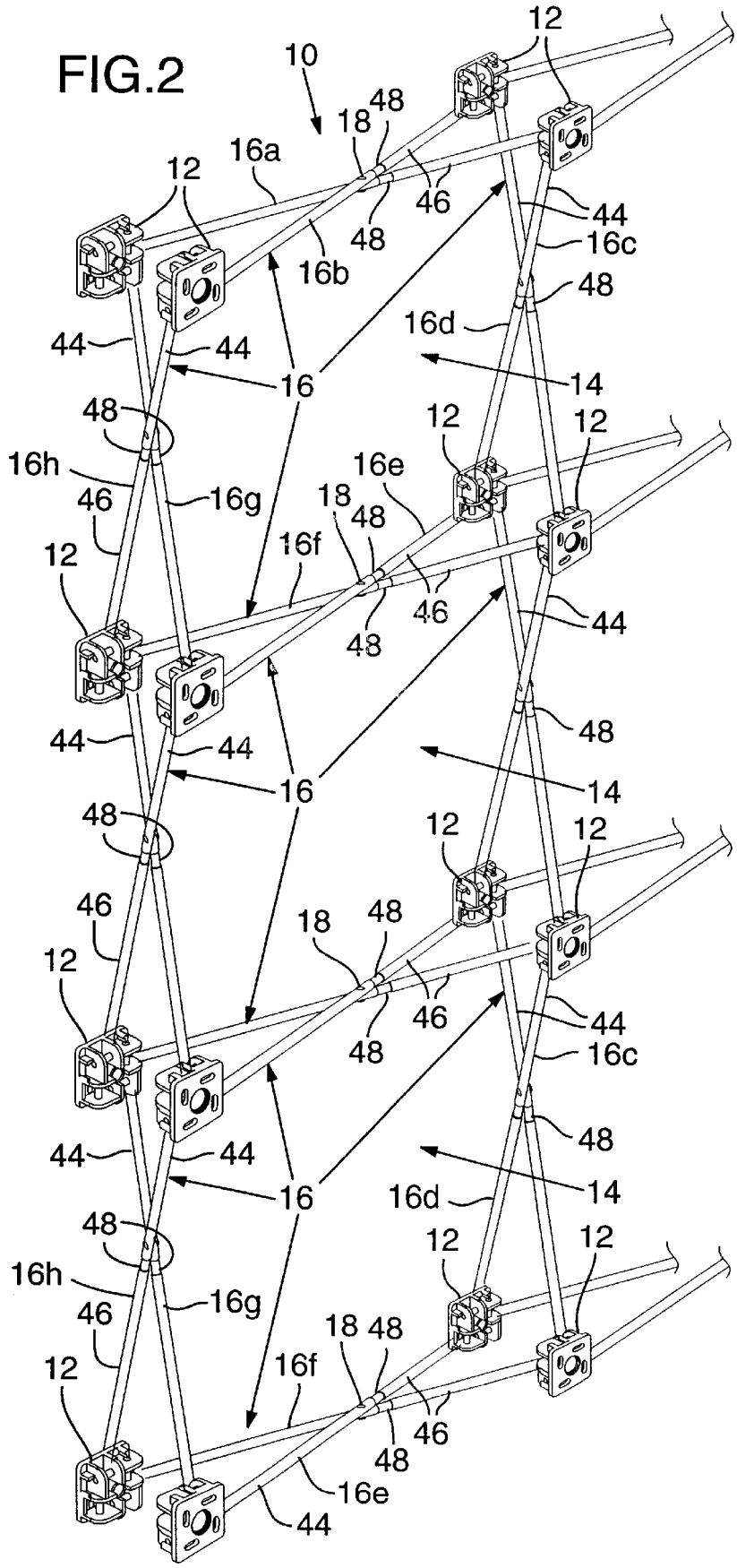
FIG. 2 is a fragmentary perspective view of a preferred embodiment of the present invention, showing the hubs disposed between the telescoping members.

A preferred embodiment of the present invention is depicted in FIGS. 2–15. FIG. 2 depicts a portion of a panel array 10 generally shaped like display 2 in FIG. 1. There are, however, a number of significant differences. Hubs 12, which define each of the box units 14 of array 10 are different in configuration from the hubs 9 of display 2. Nor are the slot and pin assemblies in telescoping arms 8 of display 2 necessary in the telescoping arms 16*a, b, e*, and *f* of panel array 10. While telescoping arms 16*a, b, e*, and *f* are substantially cylindrical and are joined by pins 18, it has been determined that the configuration of the array prevents disassembly of the telescoping arms from one another, so the slots in telescoping arms 8 of array 2 are not necessary. It can also be seen that panel array 10 does not include the vertical supports 7 which are necessary to prevent display 2 from collapsing from its weight. Instead, a system for mounting arms 16 to hubs 12 locks the position of the arms and thereby prevents the display from collapsing. It also is possible to lock the position of the horizontally extending telescoping arms, but that normally is not necessary. With a simple retrofit substitution of parts, this horizontal locking feature can be added or deleted as desired.

Figure 2A:
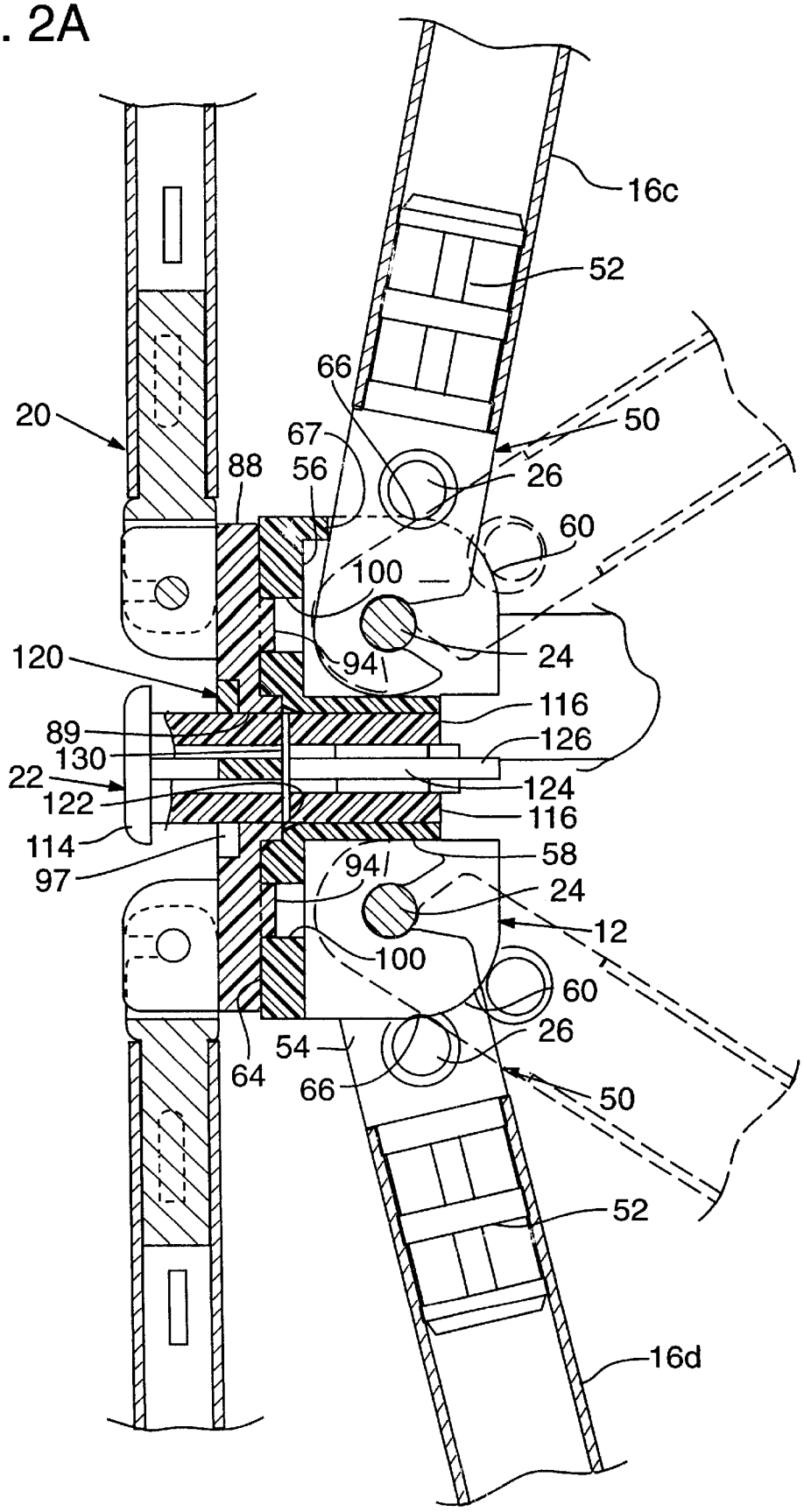
FIG. 2A is a side elevation sectional view showing a hub and its vertically extending arms, along with a mounting plate being mounted to the hub by a mounting button, also showing deflection of a locking pin as the pin travels across the corner of the hub.

FIG. 2A depicts the system by which a so-called channel bar assembly 20 can be mounted to each of the hubs 12 through the use of a two-piece mounting button 22. The channel bar assemblies provide a flat surface against which fabric and display appurtenances may be mounted so that the panel array 10 can perform its display function.

Figure 3:
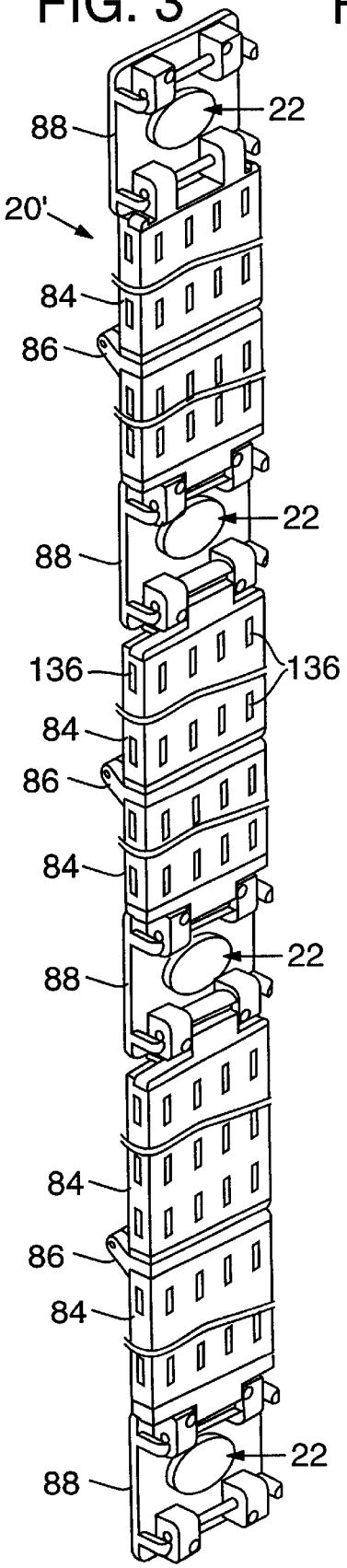
FIG. 3 is a perspective view of a channel bar assembly, with its length shortened for illustrative purposes.
Figure 3A:
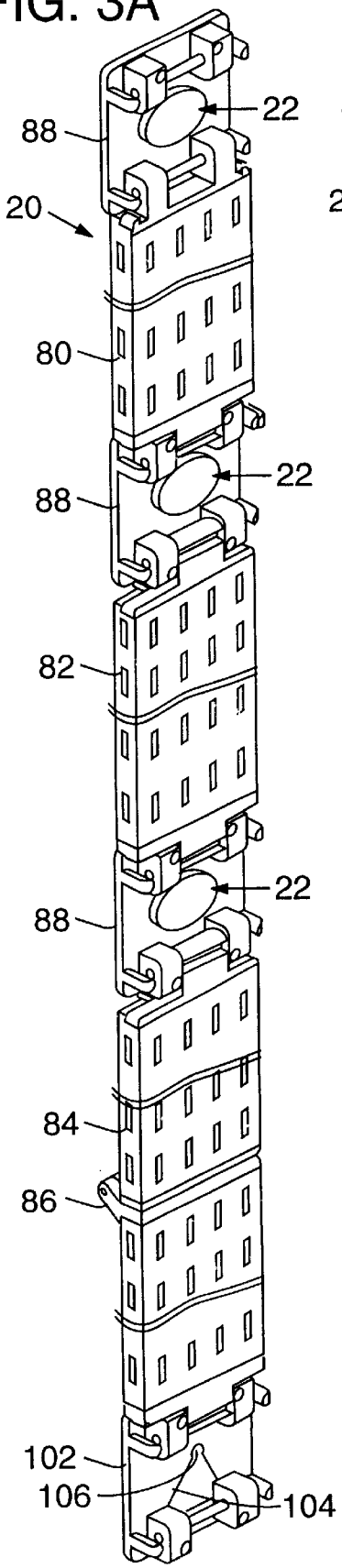
FIG. 3A is a perspective view of another embodiment of the channel bar assembly.
Figure 4:
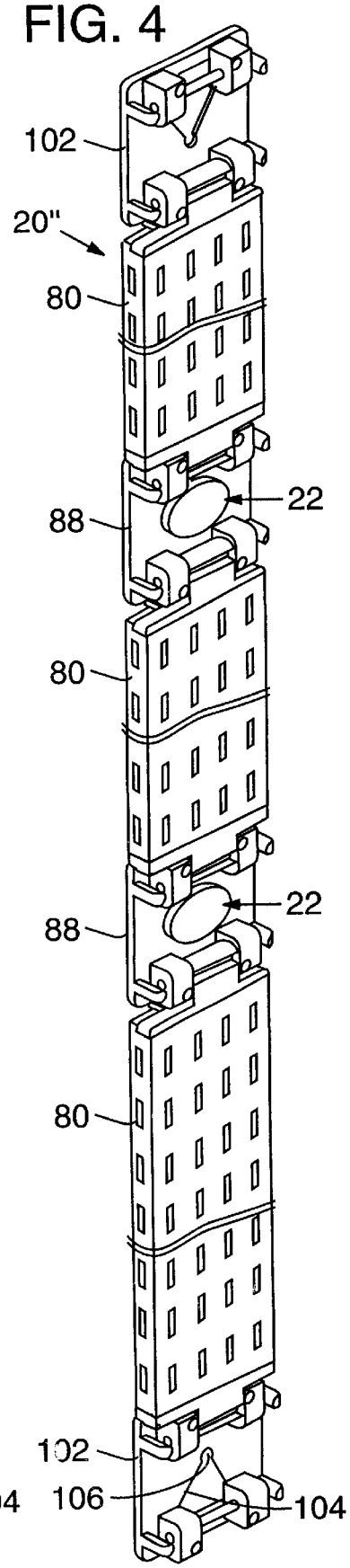
FIG. 4 is a perspective view of yet another embodiment of the channel bar assembly.

FIGS. 3, 3A, and 4 depict three variations of channel bar assembly 20, identified at 20, 20', and 20", respectively. These variations provide a wide variety of capabilities to the preferred embodiment.

Figure 6:
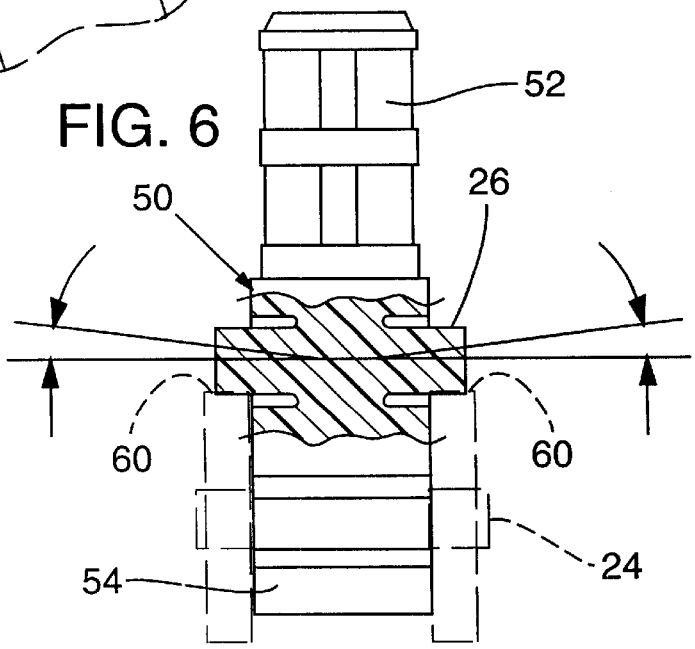
FIG. 6 is a partially sectioned view, showing the deflection of the locking pin as it travels across the corner of the hub as the vertical telescoping arms are pivoted in FIG. 2A.

The system by which the position of the arms 16 are locked into place is shown in FIGS. 2A and 6. It can be seen that each of the arms 16 is mounted to arm mounting pin 24, four of which are mounted within each of the hubs 12. Two of the arm mounting pins 24 will be parallel to each other, while the other two arm mounting pins will be parallel to each other and perpendicular to the first two pins. Each of the ends of the arms 16 also includes a locking pin 26 which, due to the fact that half of the corners of the hubs are not perfectly radiused, causes half of the locking pins to be deflected as the arms (in this case, the vertical arms) are pivoted from the position in which they extend in a direction substantially parallel to the face of the hub, to one in which they extend perpendicularly therefrom, as seen in FIG. 2A.

Figure 8:
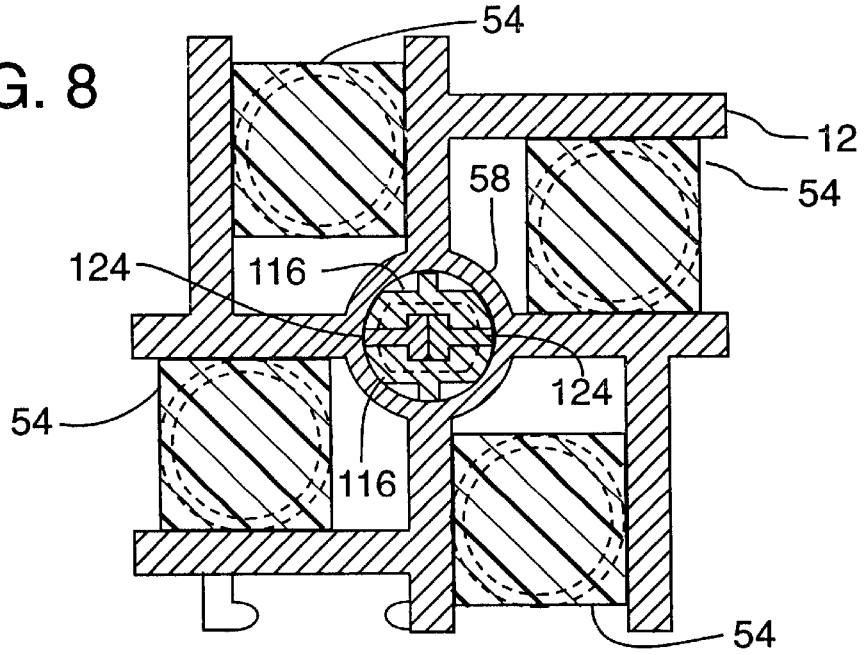
FIG. 8 is a sectional view taken along line 8—8 of FIG. 7, showing the tubular members, to the internal parts of the hub and mounting button, in section.
Figure 9A:
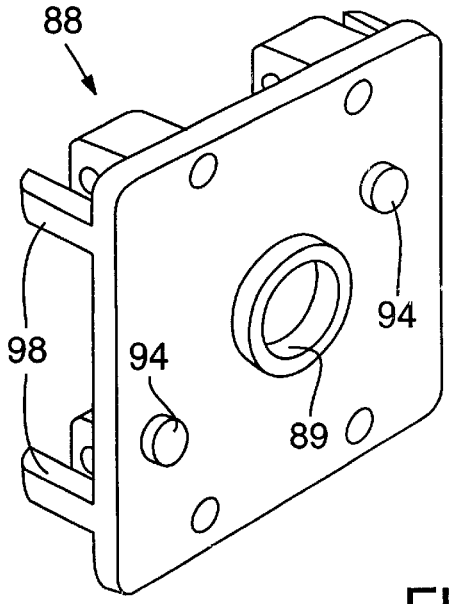
FIG. 9A is a perspective view of the rear of a channel bar mounting plate, shown at four points in FIG. 3, three points in FIG. 3A, and two points in FIG. 4.
Figure 9B:
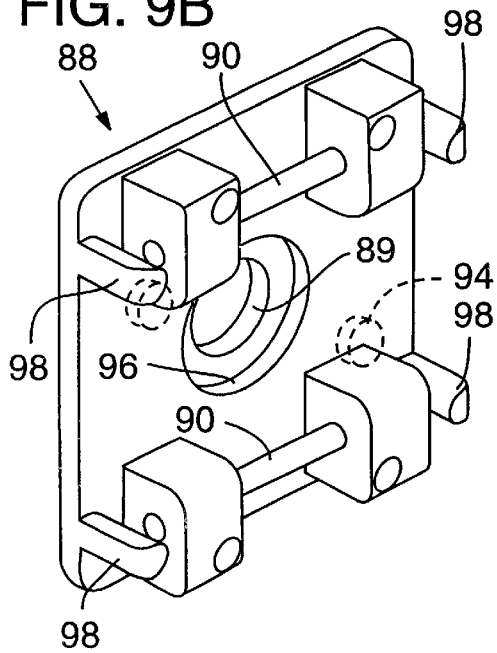
FIG. 9B is a perspective view of the front of the channel bar mounting plate of FIG. 9A.
Figure 10A:
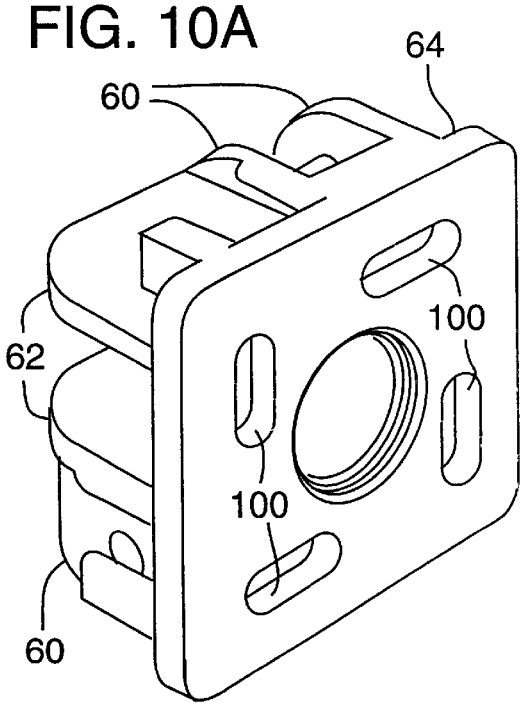
FIG. 10A is a perspective view of the front of one of the hubs of the embodiment of FIG. 2.
Figure 10B:
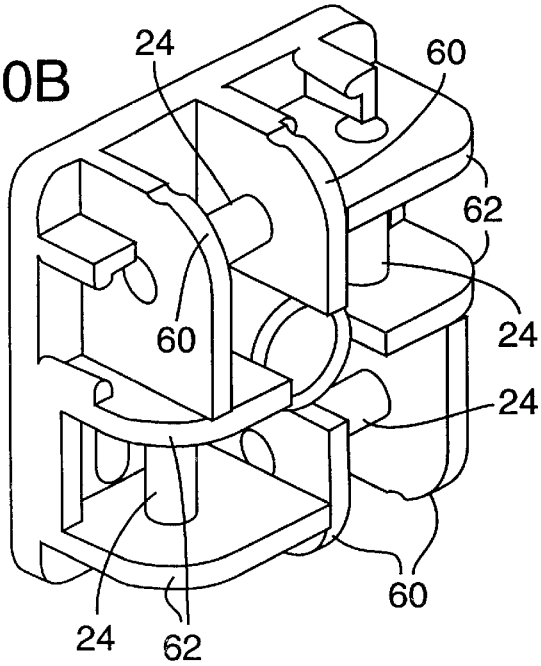
FIG. 10B is a perspective view of the rear of one of the hubs of the embodiment of FIG. 2.
Figure 10C:
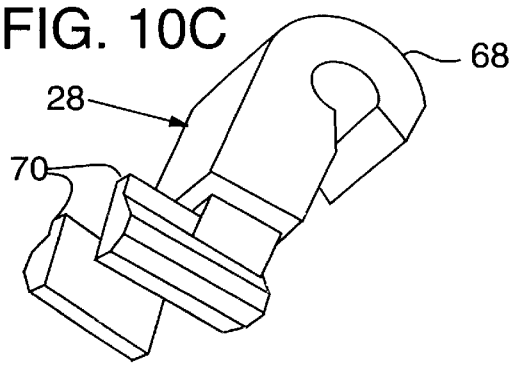
FIG. 10C is a perspective view of a link which can be used to interconnect two frame assemblies by joining together adjacent hubs.

FIGS. 8, 10A, and 10B provide various detailed views of each of the hubs, while 10C and 10D depict clips which permit the peripheral hubs of a pair of panel arrays 10 to be mounted to one another, thereby effectively doubling the size of a display. FIGS. 9A, 9B, 11A, and 11B show details of a channel bar mounting plate 88, and a channel bar V-plate, shown in FIGS. 3, 3A, and 4 to mount the channel bar assemblies 20, 20', and 20" to the hubs.

Figure 12:
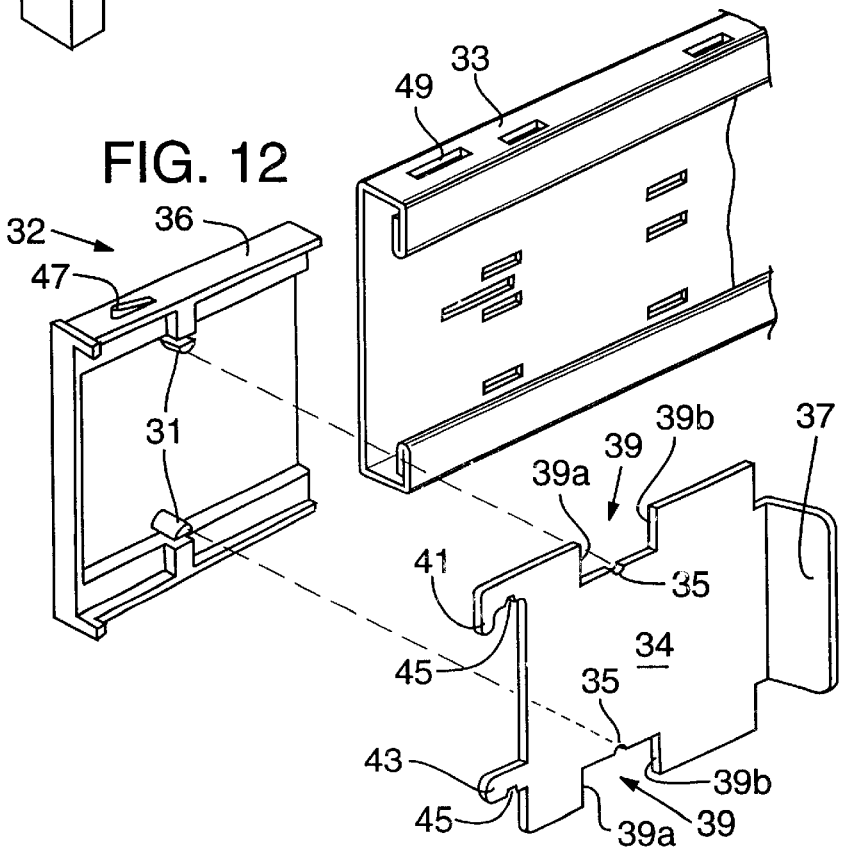
FIG. 12 is a partially exploded perspective view of a connector bar assembly, showing the connector removed from the connector bar end and the connector bar end removed from the connector bar.

FIG. 12 shows a connector bar assembly 32 which, due to the movement of a connector 34 within a connector bar end 36, permits the connector bar assembly and a display mounted to it to be mounted in various positions to channel bar assemblies 20.

Figure 15:
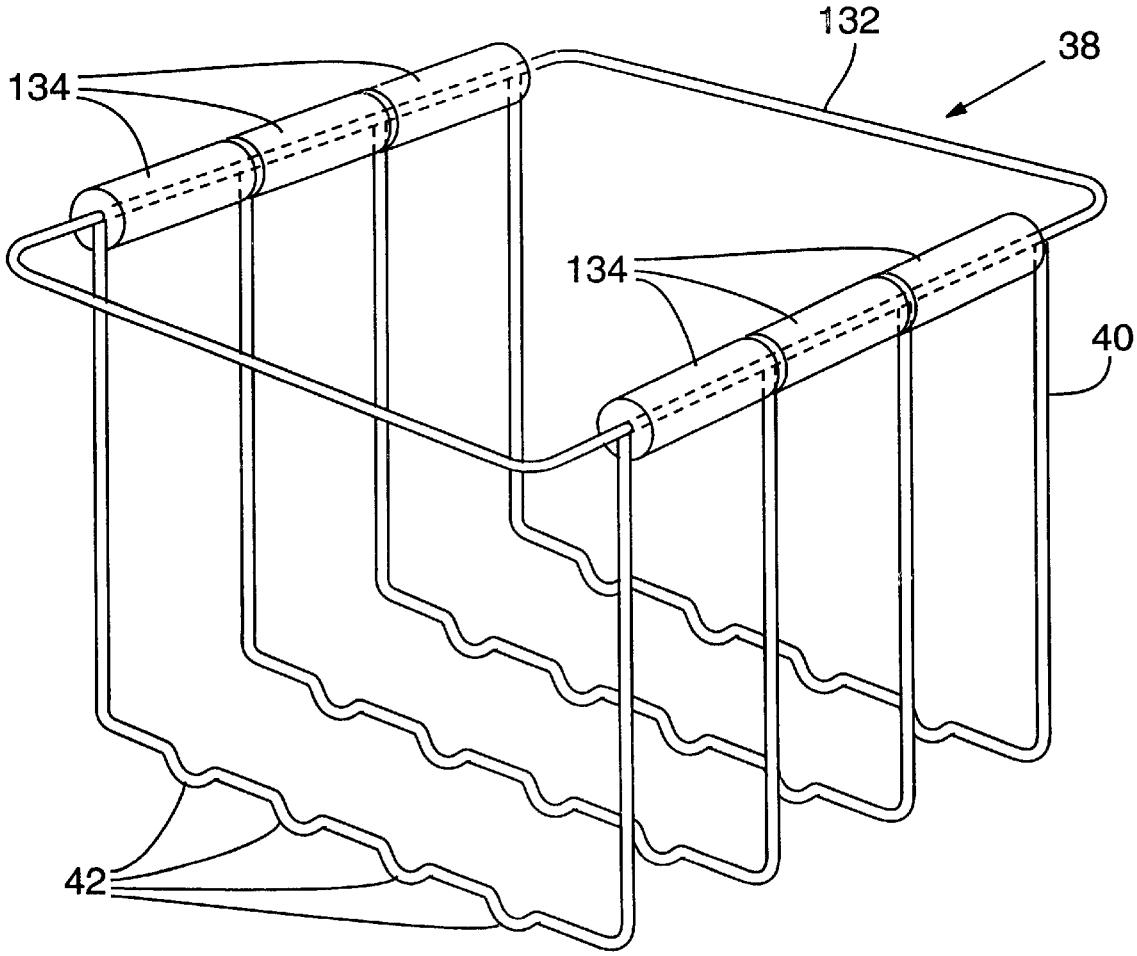
FIG. 15 is a perspective view of the channel bar assembly removal cage.
Figure 14:
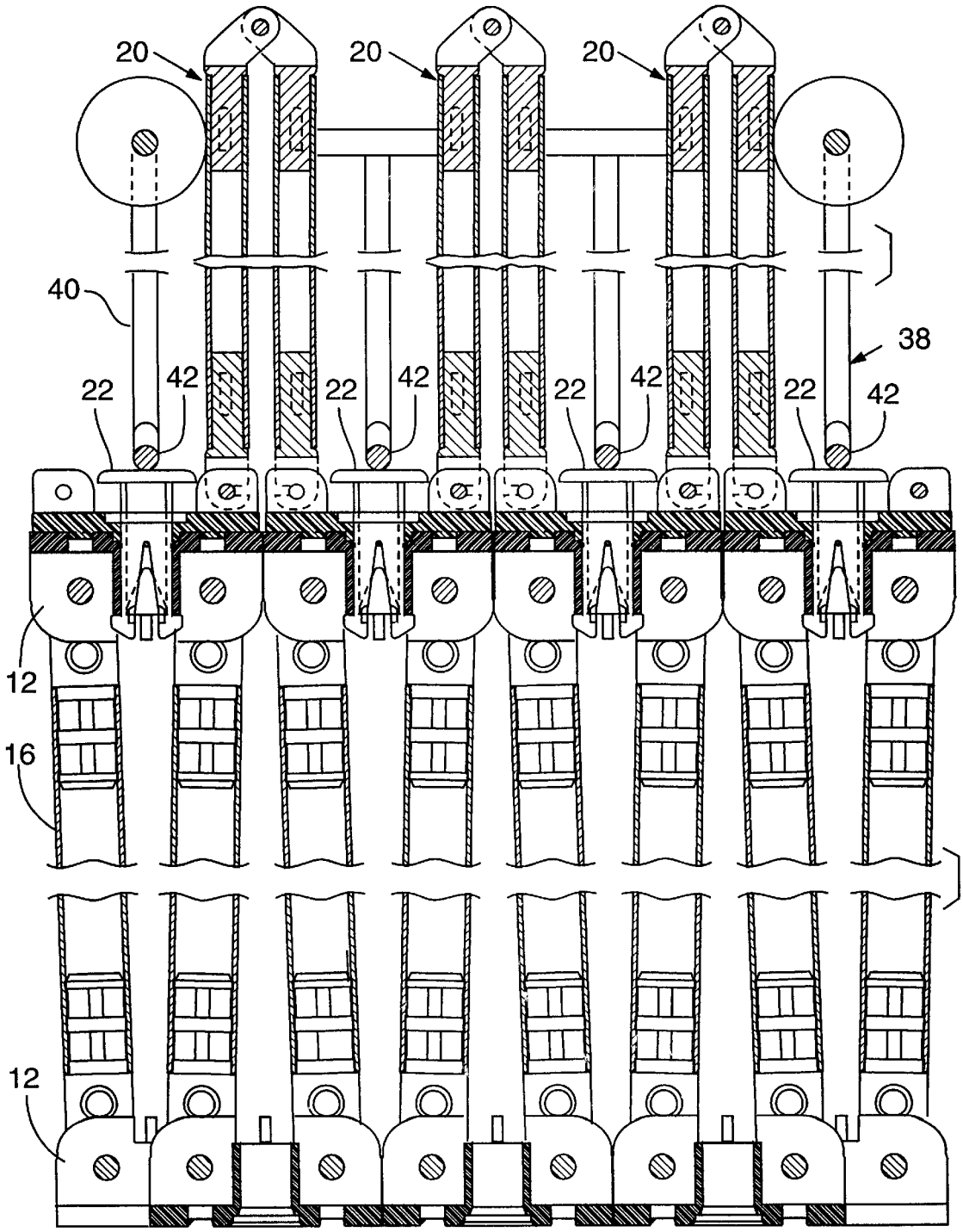
FIG. 14 is a side elevation, full assembly view of a collapsed display unit of FIG. 2, showing a channel bar assembly cage in place, ready to remove the channel bar assemblies.

It is possible, with the channel bar assemblies 20' of the preferred embodiment, manually to remove each of the channel bar assemblies from the hubs to which they are mounted. However, FIGS. 14 and 15 depict a cage which can be positioned over the collapsed display in such a manner that all of the channel bar assemblies 20' may be removed at one time. As will be explained in more detail below, the cage includes a plurality of wire members 40 having bumps 42 thereon so that when the cage 38 is mounted over the various channel bar assemblies 20' as shown in FIG. 14, these bumps can be pushed downwardly against each of the mounting buttons 22 to release all of the channel bar assemblies simultaneously. The use of cage 38 is possible only with the configuration of the channel bar assemblies 20' shown in FIG. 3. It is not possible with channel bar assemblies 20 or 20" of FIG. 3A or 4.

Referring now back to FIG. 2, the preferred embodiment will be described in more detail.

The panel array 10 includes a plurality of box units 14 which are defined by pairs of cylindrical telescoping arms 16. In FIG. 2, these arms 16 are identified individually at 16*a, b, c, d, e, f, g* and *h*. Telescoping arms 16*a, b, e* and *f* extend in a substantially horizontal direction, while telescoping arms 16*c, d, g* and *h* extend substantially vertically. As noted earlier, however, in the preferred embodiment, only the horizontal arms 16*a, b, e*, and *f* actually telescope. Each telescoping arm is comprised of a pair of enlarged portions 44 and 46, with the longer enlarged portion 44 having the pin of hinge 18 extending through it. The enlarged portions 44 and 46 are interconnected by a portion of slightly smaller cylindrical diameter 48, with the smaller portion also being pinned to enlarged portion 44 at the hinge 18. As mentioned earlier, the configuration of the telescoping arms 16 is such that the slots found in the prior art telescoping arms are not necessary to prevent removal of the one portion of the panel array from the other. While in the depicted embodiment the arms are cylindrical and therefore round in cross section, a wide variety of other configurations may be utilized.

As previously mentioned, arms 16 are mounted to hubs 12 in such a way that they are easily pivotable, but may be locked to prevent pivoting in the event that is desired. This locking capability normally is provided only in the vertically extending arms 16*c, d, g* and *h*, so when the panel array 10 is opened from its collapsed position, it can remain open without requiring any additional locking members as is necessary in the above-referenced prior art design. That is, unless there is some locking capability provided, the panel array 10 will collapse from its own weight. The vertical arm locking capability will prevent that.

Figure 5:
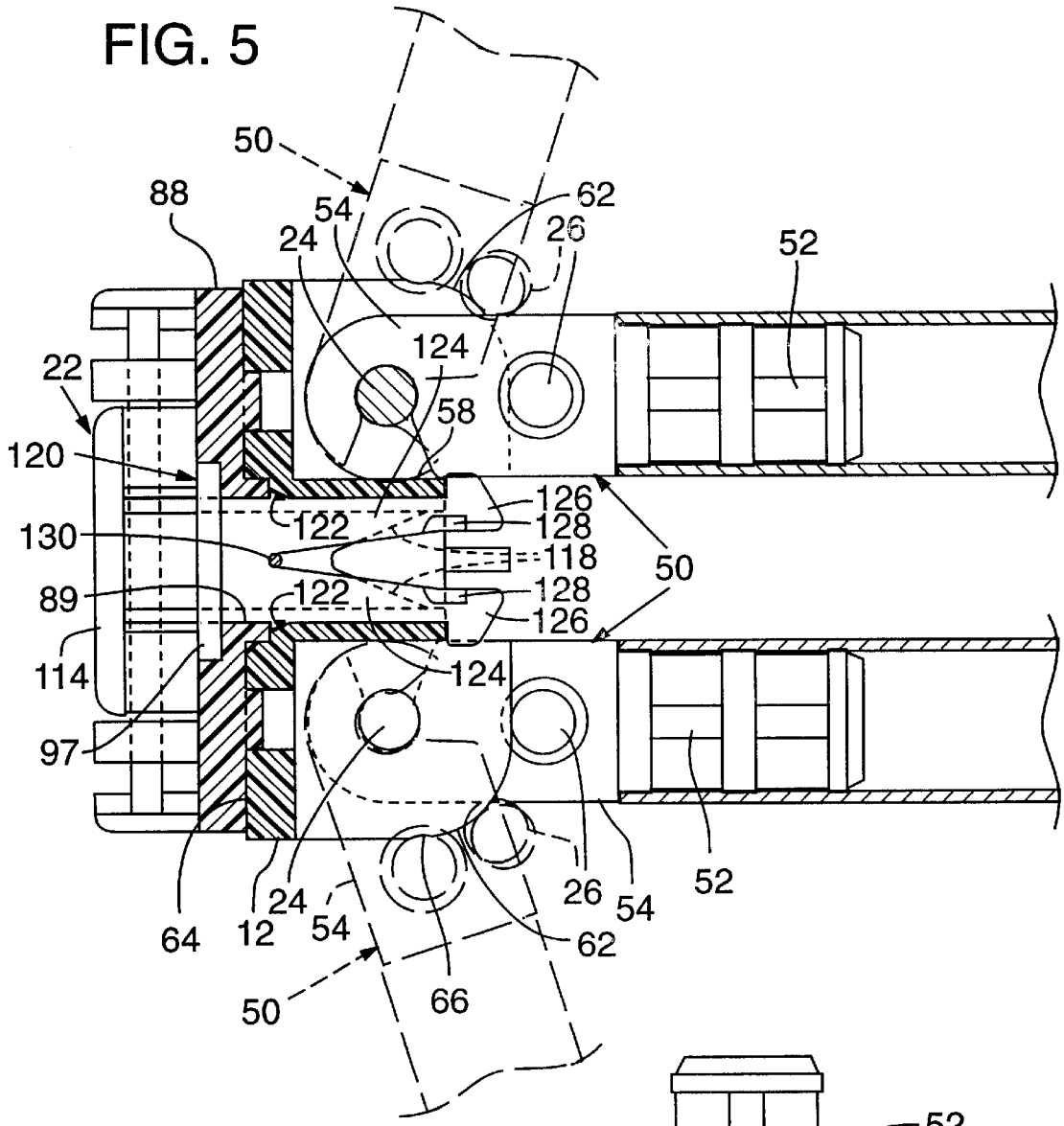
FIG. 5 is a top sectional view showing a hub, its horizontally extending arms, and a mounting plate attached by a mounting button.
Figure 7:
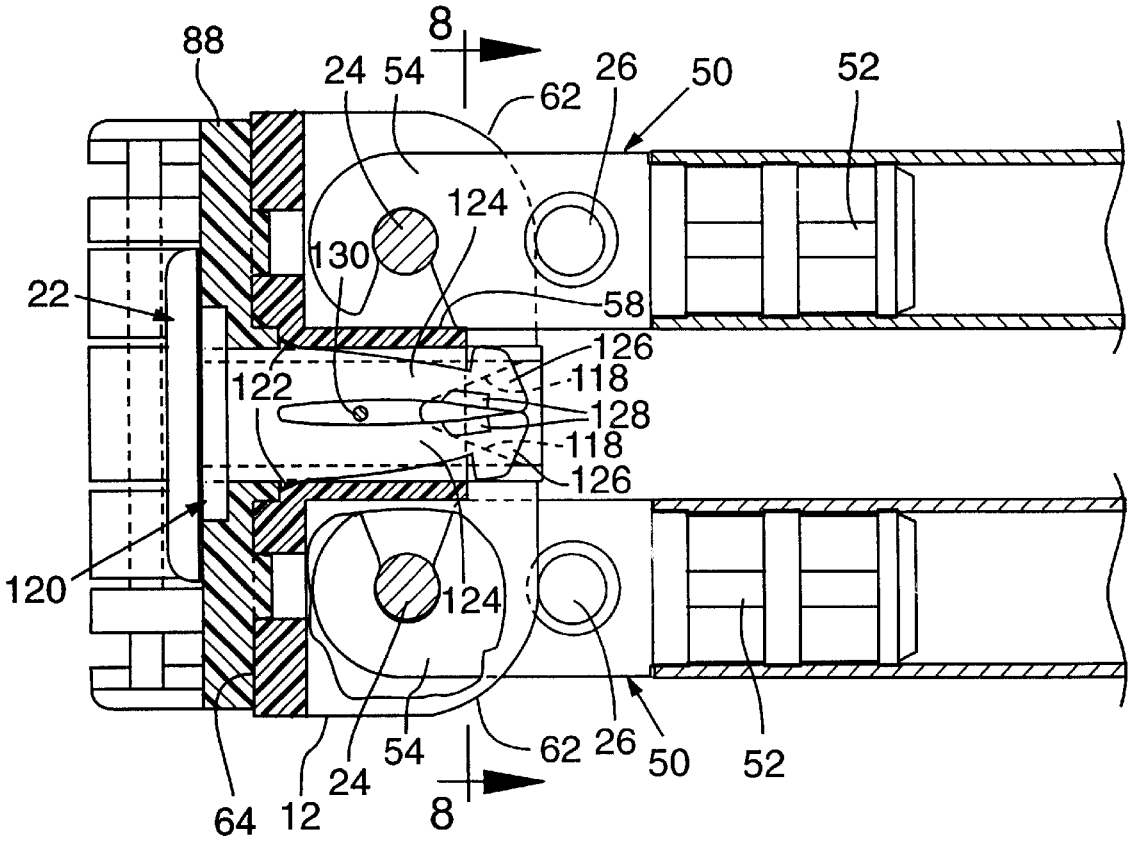
FIG. 7 is a view corresponding to FIG. 5, except that the tubular arms are shown in their collapsed positions, and the mounting button is shown to be depressed and ready to be removed.

FIG. 2A shows the system by which the vertical telescoping arms 16*c, d, g*, and *h* of the depicted embodiment are mounted to hubs 12. The mounting arrangement of horizontal arms 16*a, b, e*, and *f* is identical, as shown in FIGS. 5 and 7, except that the locking capability shown in FIG. 2A is not present. In any event, each of the arms terminates in an engagement end 50, which is mounted to each of the arms by a substantially cylindrical engagement member 52 comprised of three spaced plates. The engagement end terminates in a hook-shaped pin engagement device 54 which engages each of the arm-mounting pins 24. The fact that the pin engagement devices are hook-shaped means that they can be mounted in place and removed relatively easily. To mount the devices in place, the engagement device is merely rested on the pin, and then the arm, such as arm 16*c* in FIG. 2A, is merely pivoted upwardly, or in a counterclockwise direction as shown in FIG. 2A until the closed portion of the hook contacts a rear face 56 of hub 12. By continuing to rotate arm 16*c*, pin engagement device 54 is forced to engage arm-mounting pin 24. To remove arm 16*c*, it is merely pivoted downwardly or in a clockwise direction in FIG. 2A until it extends in a substantially horizontal direction so that pin engagement device 54 contacts a substantially cylindrical central annulus 58. By continuing to attempt to rotate arm 16*c* in a clockwise direction, pin engagement device 54 is forced off of the arm mounting pin 24. The ease with which pin engagement device 54 can engage and disengage mounting pin 24 not only facilitates initial assembly of the unit, but also permits broken pieces to be replaced and allows locking features, to be described now, to be added or deleted.

As previously mentioned, the preferred embodiment provides a method by which panel array 10 can be locked in an opened position so that it does not collapse from its own weight. As shown in FIGS. 2A, and 6, pin engagement end 50 includes a locking pin 26 which is positioned such that as the vertical arms 16*c, d, g* and *h* are pivoted, the locking pin comes into contact with a corner 60 of hub 12. Corner 60, sometimes herein called an engagement surface, is rounded, but it is not a perfect radius around mounting pin 24. If it were a perfect radius, then the locking pin would slide neatly around the corner. Because corner 60 extends beyond the normal radius, the locking pin is deflected by an angle of about 5 degrees as it passes across corner 60. This provides a resistance to rotation of arms 16*c, d, g* and *h*, which prevents the array from collapsing under its own weight or under the weight of the display mounted to it.

When the panel array 10 is shifted from its collapsed to its open position shown in FIG. 2A, the locking pin 26 slides into a small detent 66 disposed in the surface of the hub, disposed immediately past the corner 60. With the arms 16*c, d, g*, and *h* in this depicted position and the locking pin 26 in its detent 66, the back of pin engagement end 50 will abut the raised abutment surface 67 in the back of the hub 12.

While this locking feature might be provided for all of the arms, it typically is not necessary for those arms which extend horizontally, that is, arms 16*a, b, e* and *f*. However, for particular applications which require horizontal arm locking, it is possible to replace the hubs 12 with hubs having four raised corners, rather than only the two raised corners present in the preferred embodiment. Or, it is possible to rotate each of the hubs by 90-degrees to provide the locking capability in the horizontal rather than the vertical direction. Another option is to provide the raised engagement surface 60 in all four directions, and to include a locking pin 26 in only those arms in which the locking capability is desired.

In comparing FIGS. 2A and 5, it can be seen that the raised aspect of corner 60 is minimal when compared to radiused comers 62, and the difference can often not be detected easily by the naked eye.

As noted earlier, it is possible to mount two adjacent arrays together by interconnecting the peripheral outboard-most or left-most hubs in FIG. 2 to the peripheral outboard-most hubs or right-most hubs of an adjacent array (not shown). The hubs are interconnected through the use of pairs of clips 28, such as those depicted in FIGS. 10C and 10D. Each clip 28 includes a hook portion 68 which is identical to the corresponding portion of pin engagement devices 54. Each clip also includes a pair of parallel extension legs 70. These legs are designed to be disposed within a pair of slots 72 and 74 which are defined by extension members 76 and 78, respectively, in hubs 12. Each of the hubs 12 typically includes these extension members 76 and 78, although they will be nonfunctional in most applications. That is, they will be functional only when an array is mounted to an adjacent array, and then only the outer most-facing portions of the outermost hubs will have their extension members utilized.

Figure 10D:
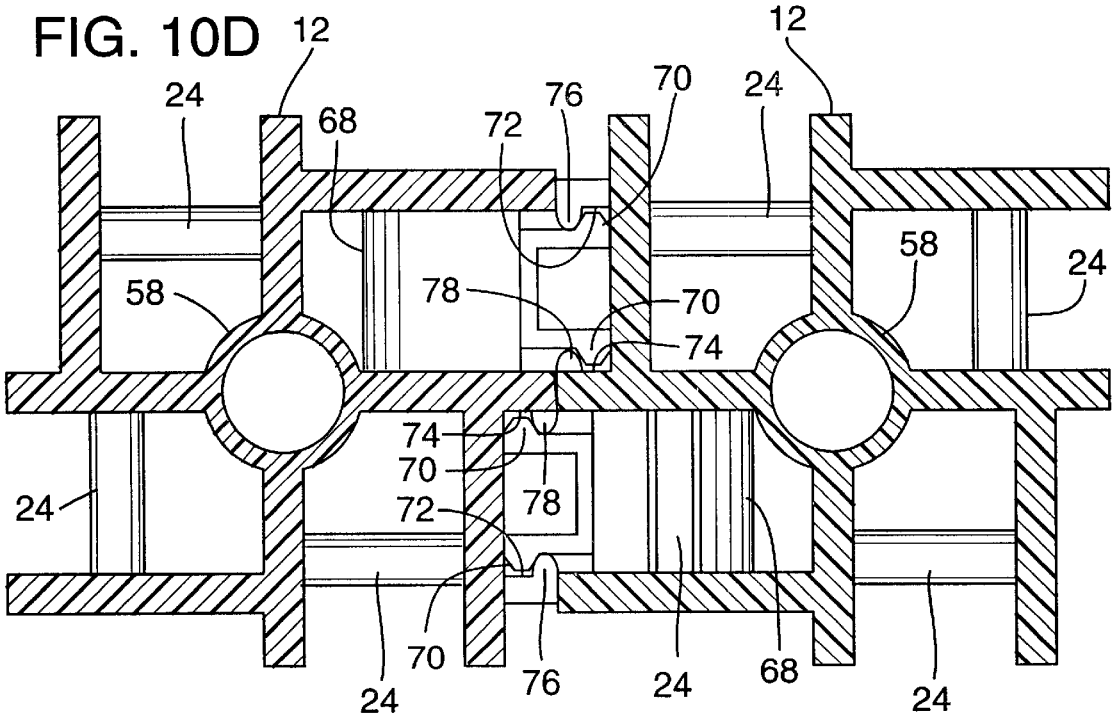
FIG. 10D is a partially sectional view of two adjacent hubs held together by two links of FIG. 10C.

As shown in FIG. 10D, in order to engage adjacent hubs, a pair of clips 10C are snapped on to the outer most vertical arm mounting pins 24 in the same manner that the pin engagement devices 54 of arms 16 would be installed. Care should be taken to mount the clips so that, when the hubs are joined, the clips will be facing in opposite directions. The outer-most hubs then are mounted, one to the other, by sliding extension legs 70 into the appropriate slots 72 and 74. Because engagement clips 28 face in different directions, this provides a secure mounting which can be easily removed when desired.

As mentioned previously, channel bar assemblies 20, 20' and 20" in FIGS. 3, 3A, and 4, respectively, provide various alternatives to one who uses the preferred embodiment of panel array 10. Each arrangement typically includes three channel members, which correspond to the number of box units vertically stacked in the array. Some of these channel bars may be hinged, depending upon the particular application. In FIG. 3A, the top two channel bars 80 and 82 of channel assembly 20 are solid members, while the third channel bar 84 is hinged at 86. In FIG. 3, all three of the channel bars 84 are hinged at 86. In FIG. 4, none of the channel bars 8 is hinged. Each of the channel bars 80, 82, and 84 is substantially C-shaped in cross section, in much the same fashion as connector bar assembly 32 shown in FIG. 12. The hinged channel bars 84 include a hinge 86 which extends substantially entirely across the width of the channel bar 84.

Disposed between each of the channel bars 80, 82 and 84, and at each end, are channel bar mounts. These mounts take two different forms. Some of the channel bar mounts are in the form of channel bar mounting plates 88, such as shown in FIGS. 9A and 9B. These mounting plates 88 include a centrally disposed circular hole 89 which receives a channel bar mounting button 22. Each of these mounting plates 88 also includes a pair of parallel pins 90 on the front side thereof. The rear side of channel bar mounting plate 88 includes a pair of alignment members 94. The hole 89 includes a countersunk step 96 which is adapted to receive a slidable washer 97 positioned on mounting button 22. Also included are four peripheral extension legs 98, the function of which will be explained below.

FIG. 2A best shows the manner in which channel bar mounting plates 88 are mounted to the front of each of the hubs 12. By positioning the mounting plate against the hub, alignment members 94 fit into two of four slots 100 defined in the face of each hub 12. Four such slots 100 are defined in the face of each of the hubs so that each hub may be adapted to receive mounting plates which may be rotated 90-degrees from the depicted arrangement.

Figure 11A:
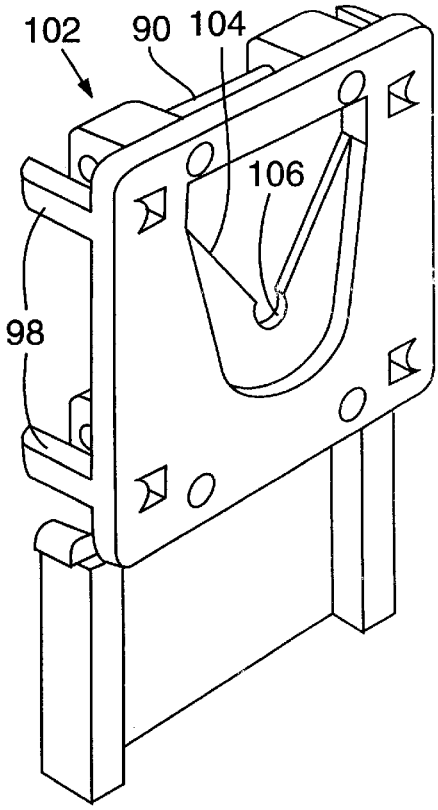
FIG. 11A is a perspective view of the rear of a channel bar V-plate, shown at the bottom of FIG. 3A and at the top and bottom of FIG. 4.
Figure 11B:
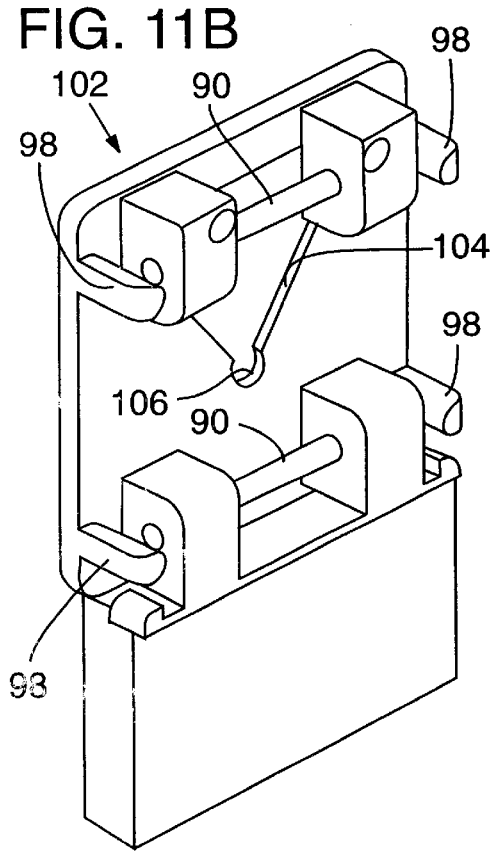
FIG. 11B is a perspective view of the front of the channel bar V-plate of FIG. 11A.

As shown in FIG. 3A, the lower hinged channel bar 84 terminates in a channel bar V plate 102. The V plate 102 is similar to each of the channel bar mounting plates 88, except that in the channel bar V plate, the round hole 89 of mounting plate 88 is replaced with a substantially V-shaped or triangular opening 104 as shown in FIGS. 11A and 11B. As shown in 11A and 11B, the channel bar V plate 102 includes the same pins 90 and the same extension legs 98 as mounting plate 88. The vortex of the V terminates in a round opening 106 which is designed to receive a so-called Euro-button, to be described below. Channel bar V plate 102 is mounted to the hubs 12 just as channel bar mounting plates 88 are, except that the V-shaped design permits hinged channel bar 84 to be slightly flexed while channel bar V plate 102 is positioned over the bottom node of the array. Then, as hinged channel bar 84 is displaced to its straightened position, such as depicted in FIG. 3A, the button disposed in the bottom node slides into round opening 106 at the vortex of V-shaped opening 104. Because of this sliding motion, alignment members 94 of mounting plates 88 are not included in V plates 102. That is, the alignment members 94 could prevent the sliding motion and are not necessary, given the self-aligning capability of the V plate.

Figure 13A:
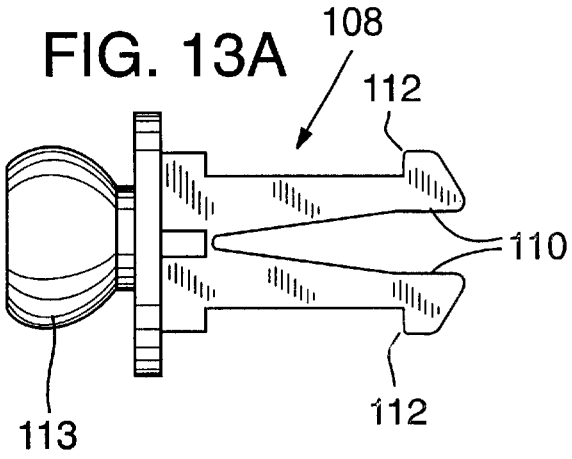
FIG. 13A is a side elevation view of a Euro-button used with the preferred embodiment.
Figure 13B:
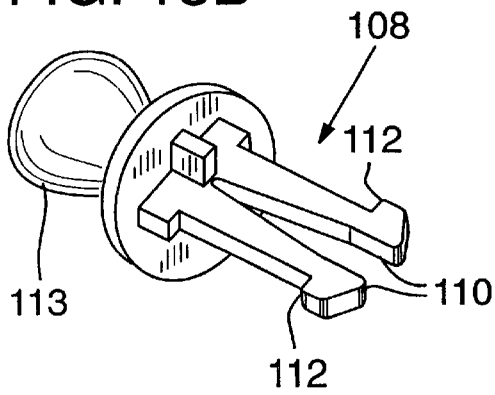
FIG. 13B is a perspective view of the Euro-button of FIG. 13A.

The button mounted in the bottom node to which channel bar V plate 102 is mounted is a conventional so-called Euro-button 108 shown in FIGS. 13A and 13B, which is merely a flat plastic button having a pair of legs 110 extending therefrom which can be slid into place easily, and can be removed by moving the legs toward one another to release the engagement. Holding the Euro-button in engagement are the flared ends 112 of the legs 110. A rounded end 113 is included to hold the V plate 102 in place. This simple Euro-button is appropriate for this function, because unlike the other mounting buttons 22, it does not need to be released in order to disengage channel bar V plate 102 from the lower-most hub 12.

Referring now again to FIGS. 2A, 5, and 7, the configuration of mounting button 22 can be seen. It includes a top 114 with a pair of spaced extensions 116 shown best in side elevation in FIG. 2A and in cross section in FIG. 8. The inner surfaces of these spaced extensions include countersunk converging or V-shaped portions 118 (see FIG. 5) which do not extend all of the way through the surface of the extensions. Also included is a second piece in the form of a slidable washer assembly 120, having a pair of opposed nibs 122 in the mounting button 22 (FIG. 5) which are designed to engage the rear portion of channel bar mounting plates 88 which is disposed in countersunk step 96 of hub 12. This prevents mounting buttons 22 from being dislodged from the channel bar mounting plates 88 to which they are mounted.

Also extending from washer assembly 120 is a pair of legs 124 which terminate at flared portions 126 and which serve to engage the annulus 58 of each of the hubs 12, as shown best in FIG. 5. These legs 124 are in contact with one another as they pass through the hub 12 as shown in FIG. 8, but they then diverge from one another and they terminate in the flared portions 126 as shown in FIGS. 5 and 7. Each of the legs 124 includes a raised portion 128 which extend upwardly and downwardly into the countersunk V-shaped portion 188 so that, when the top 114 is depressed with respect to slidable washer assembly 120, the raised portions are pushed inwardly by the countersunk V-shaped portions, to cause the legs 124 to move inwardly toward one another, as shown in FIG. 7. This causes the flared portions 126 to clear the inner diameter of annulus 58, permitting the mounting button 22 and the mounting plate 88 to be withdrawn from the hub 12. As noted earlier, however, the mounting button 22 remains engaged with mounting plate 88 as a result of nibs 122.

A plastic or steel button assembly pin 130 is included to prevent washer assembly 120 from becoming dislodged from the top of the button 114.

Another variation of the channel bar assembly is shown at 20' in FIG. 3. Channel bar assembly 20' is identical to that of assembly 20 in FIG. 3A, except that each of the three channel bars is hinged and therefore is identical in configuration to hinged channel bar 84 of channel bar assembly 20. The only other difference between channel bar assembly 20' in FIG. 3 and assembly 20 in FIG. 3A is that in FIG. 3 the bottom mounting plate is a channel bar mounting plate 88, rather than a channel bar V-plate 102 of FIG. 3A. This configuration is possible because channel bar assembly 20' can be mounted to the collapsed panel array 10, and then when the panel array 10 is opened, the channel bar assembly 20 will be fully installed and in place.

Another advantage of using channel bar assembly 20' is that each of the three channel bar assemblies 20' which would be used in a panel array can be simultaneously removed through the use of the cage 38 depicted in FIGS. 14 and 15. Cage 38 includes a wire frame 132 which is generally rectangular in configuration, having two sets of three resilient rollers 134 mounted at slightly spaced intervals along the opposite sides thereof. Wire members 40 extend at evenly spaced intervals downwardly therefrom, in a generally U-shaped configuration, and include, in the depicted embodiment, four evenly spaced, downwardly extending bumps 42. As briefly explained above, when the panel array with channel bar assembly 20' mounted thereto is in its collapsed position, wire cage 38 can be rolled onto the collapsed channel bar assembly portion of the array as shown in FIG. 14, and by pressing downwardly on the cage along the two sides which do not have rollers 134 disposed thereon, the wire bumps 42 push downwardly on the tops 114 of buttons 22, thereby disengaging the buttons from the hubs 12. This permits the three channel bar assemblies 20' to be removed simultaneously from the remainder of the panel array 10. Because mounting buttons 22 are held in place in channel bar mounting plates 88, there are no loose parts which might be lost during this disassembly process. By removing channel bar assembly 20', the two resulting packages in which the panel array 10 is shipped can be much smaller or lighter than the single, larger package which otherwise would be used.

In order to mount the channel bar assembly 20' in place, the cage 38 can be used again, so that bumps 42 in cage 38 act to push the buttons into position in the annulus 58 of each of the hubs.

The third version of a channel bar assembly is shown in FIG. 4 and identified with the number 20". This version is similar to channel bar assembly 20, except that it includes three fixed channel bars 80. Like channel bar assembly 20, it includes two centrally disposed channel bar mounting plates 88 having round holes 29 and mounting buttons 22. A channel bar V-plate 102 is disposed at each end of channel bar assembly 20", and can be used much as described previously with respect to assemblies 20 and 20' depicted in FIGS. 3A and 3, respectively. The advantage of using assemblies 20" over assemblies 20 is that the user does not need to reach all the way up to the top of the array 10 to mount the top channel bar 80. Rather, the user merely needs to push on the top channel bar 80 so that the top channel bar V-plate 102 engages the appropriate Euro-button 108 mounted to its hub 12. The V-plate 102 thus permits the Euro-button 108 to slide through the V-shaped opening 104 and into rounding opening 106.

Reference now should be made to FIG. 12 which depicts a connector bar assembly 32 which can be mounted onto slots 136 disposed along the side edges and front faces of channel bars 80, 82 and 84 of channel bar assemblies 20, 20' and 20".

The connector bar assembly includes a connector bar 33, a connector bar end 36, and a connector 34. As shown in FIG. 12, the connector 34 fits into the connector bar end 36, which in turn fits into the connector bar 33. The connector 34 includes a pair of notches 35 which are engaged by a pair of matching connector engagement members 31. The notches 35 are defined within a squared cut out portion 39 in connector 34, defined between a forward wall 39*a* and a rearward wall 39*b*. A connector adjustment flange 37 permits the user to adjust the position of the connector 34 among three positions. The central position would be with notches 35 engaged by connector engagement members 31. The leftmost or most extended position would be with the connector engagement members 31 in abutment against the rearward wall 39*b*. In its rightmost or retracted position, the connector engagement members 31 are in abutment with the forward wall 39*a*.

The connector 34 would be in its retracted or rightmost position (in FIG. 12) when it is being shipped or otherwise is not being used. The connector 34 would be in its central position when it is being used to engage any of the extension members 98 in mounting blocks 88 or V blocks 102. These extension members 98, therefore, ensure that the connector assemblies 32 can be mounted at any height along the panel array 10, even at the height of the mounting plates 88 or V plates 102.

The connector bar 33 also includes a pair of slots 49, only one of which shows in FIG. 12, adapted to receive a pair of ramped detents 47, again only one of which appears in FIG. 12.

The connector 34 further includes a hooked portion 41 and a slightly hooked portion 43 which are adapted to engage the channel bars 80, 82, and 84 or the extension members 98. The hooked portion 41 includes a longer downward portion so that it can engage the member to which it is being mounted, and then the connector 34 can be tilted downwardly to bring the slightly hooked portion 43 into engagement. A pair of small grooves 35 are provided so that when the connector 34 engages the sheet metal channel bars

80, 82, or 84, the sheet metal is engaged in the grooves. In the event the connector 34 is mounted to extension member 98, these grooves 45 are non-functional.

Various changes and modifications can be made to the preferred embodiment without departing from the spirit or scope of the present invention. Those changes and modifications are to be encompassed within the claims that follow.

I claim:

1. A portable display system comprising:

a collapsible frame, including a plurality of box units, each of which is defined by a plurality of pairs of members which are pivotable with respect to one another along a pivot axis;

a plurality of hubs to which the members are mounted pivotably;

at least some of the members having deflectable extensions mounted thereto adjacent each of the hubs, the extensions extending in a direction substantially parallel to the pivot axis;

the hubs having an engagement surface which is engaged by the deflectable extensions as their respective members are pivoted through a plurality of angular positions with respect to the hubs;

a radius being defined by the deflectable extensions as their respective members are pivoted with respect to the hubs, the engagement surface including a corner extending beyond the radius at an intermediate one of the plurality of angular positions, so that the deflectable extension will be deflected at the intermediate angular position to provide resistance to the pivoting and thereby provide a locking capability.

2. The system of claim 1 wherein the deflectable extensions are in the form of resilient extensions that include portions for engaging the engagement surface, and wherein the portions of the resilient extensions that engage the engagement surface extend substantially perpendicularly with respect to the members.

3. The system of claim 2 wherein the hubs each include member-mounting pins to which the members are mounted pivotably, and wherein the engagement surface is a rounded surface which extends beyond the radius.

4. The system of claim 1 wherein the hubs each include member-mounting pins to which the members are mounted pivotably, and wherein the radius is defined around the pin.

5. The system of claim 4 wherein each of the extensions is radially spaced from its member-mounting pin.

6. The system of claim 1 wherein each of the extensions is radially spaced from its respective pivot axis.

7. The system of claim 1 wherein some of the members extend vertically, and other extend horizontally, and the engagement surfaces extending beyond the radius are provided with respect to the vertically extending members.

8. The system of claim 1 wherein at least some of the members telescope and are mounted pivotally to another member in a scissors arrangement.

9. A portable display system comprising:

a collapsible frame including a plurality of box units defined by a plurality of members pivotally mounted to each other and to an array of hubs, each of the members being pivotally mounted to one of the hubs by a hook-shaped mounting, the hubs each including a plurality of member-mounting pins extending parallel to a face of the hubs, wherein the hook-shaped mountings each engage one of the plurality of member-mounting pins, and further wherein the face of each of the hubs includes a surface defined in the hub, the surface having a protruding element that extends from the surface toward one of the pins, far enough such that the member will contact the protruding element before pivoting to a position parallel to the surface.

10. The system of claim 9 wherein the hook-shaped mountings are mounted removably to the pins, with each hook-shaped mounting being mounted to one of the hubs by partially engaging one of the pins and then rotating the hook-shaped mounting in a first direction until the mounting contacts the protruding element, thereby forcing the hook-shaped mounting into engagement with the pin.

11. A portable display system, comprising:

at least two collapsible arrays, each of the arrays including a collapsible frame having a plurality of box units formed between pairs of members pivotally mounted one to another, extending between the hubs, each of the hubs including at least one pair of parallel pins to which the members are mounted pivotally, each of the hubs also defining a slot, wherein a hub on one of the arrays is adjacent a hub on another of the arrays; and a pair of clips, each having a hook-shaped member which removably engages one of the pins on one of the adjacent hubs, each clip also having a pair of parallel extension legs which removably engage the slot defined on the other one of the adjacent hubs, wherein each clip has a length and each of the adjacent hubs has a width, and wherein the clips connect the adjacent hubs so that the adjacent hubs are spaced apart by less than the width of the adjacent hubs.

12. A collapsible display system comprising:

a collapsible frame having a plurality of parts assembled to create the frame, the collapsible frame further having a plurality of points, the depression of which results in disengagement of some of the parts of the frame from one another; and a cage which can be mounted upon the frame when the frame is in a collapsed mode, the cage having a plurality of raised portions spaced to simultaneously engage at least some of the points and permitting depression thereof to disengage some of the parts of the frame from one another.

13. A portable display system, comprising:

at least two collapsible arrays, each of the arrays including a collapsible frame having a plurality of box units formed between pairs of members pivotally mounted one to another, extending between hubs, each of the hubs including at least one pair of parallel pins to which the members are mounted pivotally, wherein a hub on one of the arrays is adjacent a hub on another of the arrays; and a clip having first and second ends, the first end removably engaging one of the adjacent hubs, the second end removably engaging the other of the adjacent hubs, wherein the clip has a length and each of the adjacent hubs has a width, and wherein the clip connects the adjacent hubs so that the adjacent hubs are spaced apart by less than the width of the adjacent hubs.

14. The display system of claim 13, wherein the clip includes a hook-shaped member at the first end of the clip, and wherein the adjacent hubs each have a slot defined thereon, the hook-shaped member removably engaging a pin of one of the adjacent hubs, the second end of the clip removably engaging the slot defined on the other adjacent hub.

15. The display system of claim 14, further comprising a second clip having first and second ends with a hook-shaped member at the first end, the hook-shaped member removably engaging a pin of one of the adjacent hubs, the second end of the clip removably engaging the slot defined on the other adjacent hub.

16. A portable display system comprising:

a collapsible frame including a plurality of box units defined by a plurality of members pivotally mounted to each other and to an array of hubs, each of the hubs having a central portion, and each of the members being pivotally mounted to one of the hubs by a hook-shaped mounting, wherein the face of each of the hubs includes a surface defined in the hub, the surface having a protruding element that extends from the surface toward one of the pins, far enough such that as the member is pivoted to extend away from the central portion of the hub, the member will contact the protruding element before pivoting to a position parallel to the surface.

* * * * *